United States Patent [19]

Nestvall et al.

[11] Patent Number: 4,985,005

[45] Date of Patent: Jan. 15, 1991

[54] BOAT-PROPELLER UNIT

[75] Inventors: Per Nestvall, Göteborg; Christian Rodskier, Torslanda, both of Sweden

[73] Assignee: AB Volvo Penta, Göteborg, Sweden

[21] Appl. No.: 426,448

[22] Filed: Oct. 25, 1989

[30] Foreign Application Priority Data

Nov. 24, 1988 [SE] Sweden ..... 8804250

[51] Int. Cl.[5] ..... B63H 5/12

[52] U.S. Cl. ..... 440/2000; 440/53000

[58] Field of Search ..... 440/2, 6, 53, 57, 58, 440/59; 114/144 E; 340/689, 987; 324/207, 208

[56] References Cited

U.S. PATENT DOCUMENTS 4,624,643 11/1986 Ohlsson et al. ..... 440/2
4,741,713 5/1988 Ohlsson et al. ..... 440/2
4,789,362 12/1988 Holt et al. ..... 440/2
4,865,568 9/1989 Kolke ..... 440/53

FOREIGN PATENT DOCUMENTS 398094 12/1977 Sweden .
449080 4/1987 Sweden .

*Primary Examiner*—Sherman Basinger
*Assistant Examiner*—Stephen P. Avila
*Attorney, Agent, or Firm*—Young & Thompson

[57] ABSTRACT

A boat-propeller unit comprises a carrier (4), a propeller-leg (5) and a sensor (13) which senses the angle of the propeller-leg relative to the carrier and which is intended for connection to an electrical indicating instrument mounted on the instrument panel of the boat. The sensor is of the kind which produces an output signal which varies as the distance of the sensor from an object and which is located centrally of a surface (11) on the propeller-leg, the distance of which from the sensor varies with changes in the angle of the propeller-leg relative to the carrier.

5 Claims, 2 Drawing Sheets

BOAT-PROPELLER UNIT

Figure 1:
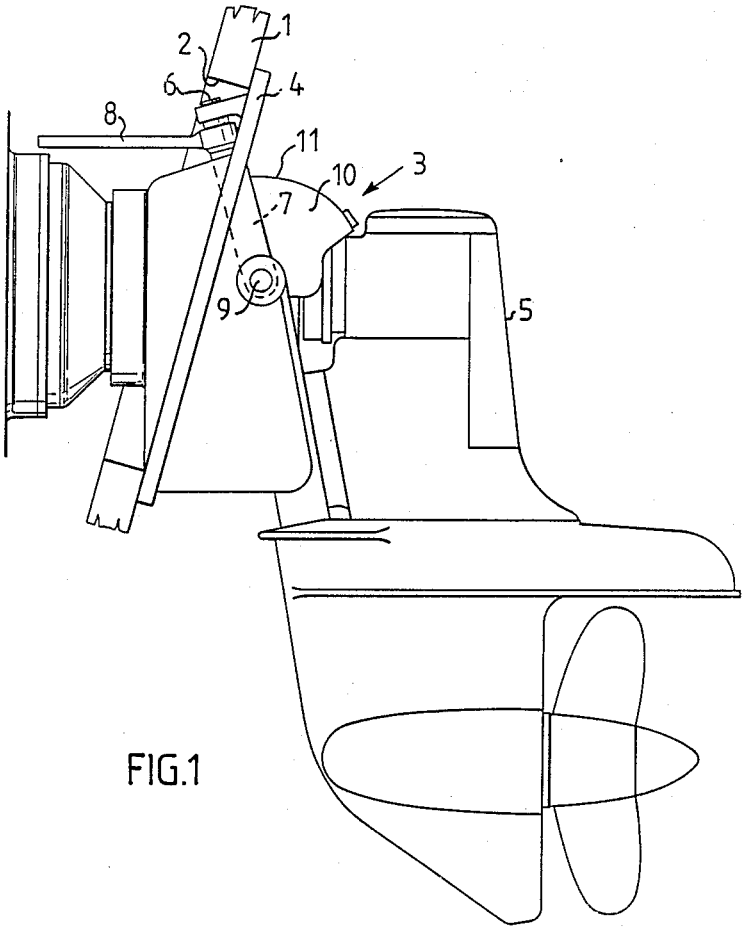

The present invention relates to a boat-propeller unit comprising a carrier which can be mounted rigidly to the transom of a boat, and a propeller-leg which is carried by the carrier and which can be tilted around a horizontal shaft for adjustment of the propeller-leg to selected angles relative to the carrier and which can be swung around a steering axis which extends in a vertical plane, and wherein means are provided for sending a signal which corresponds to the tilt-angle of the propeller-leg to an angle indicating instrument.

Boat-propeller units of this kind, such as inboard-outboard drives, for instance, can be "trimmed" in different positions relative to the carrier, i.e. relative to the boat-transom, so as to adjust the position of the propeller-leg to the attitude of the boat in the water. Modern propeller-units of this kind are provided with an electric sensor which is coupled to a position indicator mounted on the instrument panel of the boat and operative to indicate the prevailing trim and tilt angle.

Of the different kinds of sensor arrangements known to the art mention can be made here of the kind in which the sensor is coordinated with the tilting axle, and also of the kind in which a sensor is intended to coact with the steering shaft and a position indicator is mounted on the propeller-leg. SE 449 080 teaches a sensor arrangement of this latter kind, in which the sensor has the form of a rotary potentiometer which has mounted on the shaft thereof a toothed wheel or pinion which meshes with a "rack" mounted on a helmet which forms a connecting element between the steering shaft and the propeller-leg. The advantage with this solution over the solution first mentioned is that all electrical equipment can be placed so as to be protected against water-splashes, i.e. can be placed on the inward side of the carrier or the shield which forms the propeller-suspension on the boat-transom and through which the steering shaft extends The object of the present invention is to provide a further development of this latter type of sensor arrangement which will obviate the need for mechanical connection between the tilt-angle sensing components on that part of the propeller unit mounted on the transom and on the propeller-leg, so as to provide a construction which is not affected by wear and which is particularly insensitive to the ambient environment.

This is achieved in accordance with the invention with a boat-propeller unit of the aforesaid kind which incorporates a signal-producing device which includes a sensor of known kind capable of producing an output signal in dependence on the distance to a surface of an object, and also an object which coacts with the sensor; and in which arrangement the sensor and said surface of said object are so arranged in relation to one another on the carrier and on the propeller-leg respectively that the distance therebetween changes in response to changes in the tilt-angle of the propeller-leg, with subsequent changes in the output signal from the sensor.

Such a sensor can be placed advantageously in the bore provided in the steering shaft, this bore being used previously to accommodate the shaft of the rotary potentiometer. The sensor used can be of any known kind capable of indicating the presence of a magnetizable object and also capable of producing, within a defined area, a signal which will vary with the distance to the object. The aforementioned "rack" mounted on the helmet can then be replaced with a strip of magnetizable material which is curved in an arc which is excentric relative to the tilt-axle of the propeller-leg. The distance between the outer end of the sensor and the surface of said strip will thus vary in dependence on the angle defined between the propeller-leg and its carrier (the shield).

The invention provides a completely contactless angle-sensing arrangement which can be used with a known propeller unit with only negligible modification thereto.

Figure 2:
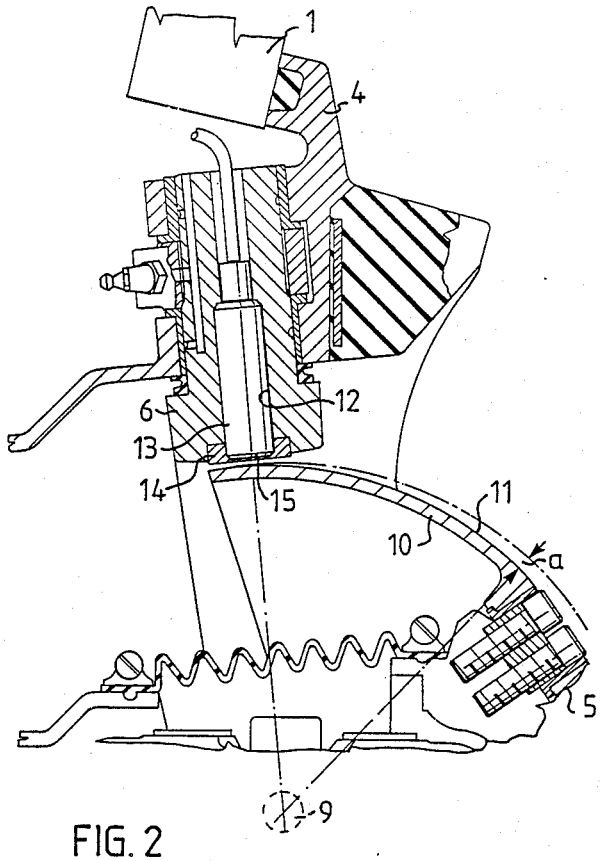

The invention will now be described in more detail with reference to an exemplifying embodiment thereof illustrated in the accompanying drawings, of which FIG. 1 is a side-view of a known inboard-outboard drive, and FIG. 2 is a longitudinal section through the steering shaft and helmet of a drive constructed in accordance with the invention. In FIG. 1 the reference 1 identifies the transom of a boat, said transom having provided therein an aperture 2 in which there is mounted a boat-propeller unit of the kind normally referred to as an inboard-outboard drive and which is shown generally at 3. The drive includes a carrier or shield 4, which is mounted on the transom, and a propeller-leg 5 which is suspended from the shield 4. A steering shaft 6 having a fork 7 is journalled to the shield and is connected to a steering arm 8 which is intended to be connected to the steering lever of the boat or vessel. The outer ends of the legs of the fork 7 have provided thereon journal pins 9 which pivotally mount a helmet 10. The helmet 10 covers the drive-shaft couplings and is connected to the propeller-leg 5 for the purpose of transferring the torque generated by the steering-shaft to the propeller-leg. In the case of the illustrated embodiment, the surface 11 of the helmet is curved in a plane of symmetry around an arc whose center lies on the center axis of the tilt-axle 9. The angle at which the propeller-leg 5 is tilted in relation to the transom can be adjusted with the aid of piston-cylinder devices (not shown) so-called trimming and tilting piston-cylinder devices, positioned between the shield 4 and the propeller-leg 5, so as to be able to adapt the positional setting of the propeller-leg to the prevailing attitude of the boat in the water, the depth of water through which the boat moves, etc.

FIG. 2 is a longitudinal, sectional view of a steering shaft 6 and a helmet 10, which form part of a drive of the same principle of construction as the drive illustrated in FIG. 1, but modified with respect to the configuration of the helmet 10.

The curvature of the helmet 10 in FIG. 1 in the plane of symmetry, i.e. the arc whose center lies on the center of the tilt- shaft 9, is shown in chain in FIG. 2. As will be seen from FIG. 2, the helmet configuration of the FIG. 2 embodiment is different from that of the FIG. 1 embodiment, insomuch as the helmet is curved in the plane of symmetry about an arc which is excentric in relation to the arc of curvature of the helmet shown in FIG. 1. As a result, the distance between the surface 11 of the helmet and the overlying parts of the carrier 4, e.g. the lower end of the steering shaft 6, will change with changes in the angle subtended by the propeller-leg 5 and the carrier or shield 4. In the case of the illustrated embodiment, the curvature is such that the distance between the surface 11 of the helmet is smallest when the propeller-leg 5 is at its lowermost, and greatest when the propeller-leg is raised to its maximum, although the opposite may equally as well be the case.

In practice, the distance differential is in the order of 5 mm.

As shown in FIG. 2, the steering shaft 6 is configured with a central, through-passing bore 12, which accommodates a sensor 13 and a protective cover 14. The sensor 13 is of known kind and functions to produce an electric signal which is contingent on the distance from the outer end 15 of the sensor to an object located in front of said outer end. The sensor may be an inductive sensor, for instance a sensor of the kind sold under the trade designation Telemecanique XSP HO 8362, which indicates the presence of a magnetizable object and the distance thereto. Consequently, when the material from which the helmet is made, or at least the material located in the region of the symmetry plane, is magnetizable, the sensor 13 will produce a signal which is contingent on the angular setting of the propeller-leg in relation to the boat and which can be fed into an instrument from which said angular setting can be read-off immediately. This function can also be achieved in a very simple fashion, even when the actual helmet contains no magnetizable material. In this latter case, it suffices to bond to the center part of the helmet a magnet tape of the same kind as standard audiovideo tape.

Theoretically, the inductive sensor can be replaced with an ultrasonic or infrared light sensor operative to measure the distance to an object which moves in response to changes in the tilt-angle of the propeller-leg. In all events, an optical sensor is more sensitive positionwise, due to the fact that its performance can be influenced by dirt and water-splashes, for instance. Instead of changing the shape of the helmet as a whole, as in the case of the illustrated embodiment, an arcuate helmet which curves concentrically with the tilt-axis can be retained and a ridge having the longitudinal section shown in FIG. 2 can be built-up on the helmet.

We claim:

1. In a boat-propeller unit comprising a carrier which can be mounted rigidly on a boat-transom, and a propeller-leg which is carried by the carrier and which can be adjusted to different angles relative to the carrier, by tilting the propeller-leg about a horizontal axis, and which can be swung about a steering axis which lies in a vertical plane, wherein means are provided for transmitting a signal contingent on the tilt-angle of the propeller-leg to an angle-indicating instrument; the improvement in which said means comprises a sensor (13) of the kind which produces an output signal which is dependent on the distance to a surface on an object, and an object (10) adjacent the sensor; the sensor and the surface on said object being so arranged in relation to one another on the carrier (4) and the propeller-leg (5) respectively that the distance therebetween changes in response to changes in the tile-angle on the propeller-leg thereby to change the sensor output signal.

2. A boat-propeller unit according to claim 1, wherein the sensor (13) is connected with a steering shaft (6) journalled on the carrier (4); and said object (10) comprises a body which is connected to the propeller-leg (5) and which has an extension perpendicular to the direction of the tilt-axis.

3. A boat-propeller unit according to claim 2, the sensor (13) is mounted in a central bore (12) in the steering shaft (6); and said object (10) has the form of a body which is so curved arcuately in front of the sensor that the distance between one end (15) of the sensor (13) and an opposing surface (11) on said body varies with varying tilt-angles of the propeller-leg.

4. A boat-propeller unit according to any one of claim 2 in which the steering shaft (6) is provided with a fork (7) which engages over a helmet (10) which is connected to the propeller-leg (5) and pivotally journalled on journal pins (9) on the legs of said fork, and wherein the sensor (13) is mounted in a bore (12) located in one end of the steering shaft (6) remote from the helmet (10); and when seen in longitudinal section the outer surface (11) of the helmet is curved in the plane of symmetry an in arc which is excentric with respect to the tilt-axis.

5. A boat-propeller unit according to claim 4, the sensor (13) is an inductive sensor; and the helmet (10) has a surface layer of magnetizable material at least in the region located opposite the end (15) of the sensor.

* * * * *